United States Patent [19]

Raney, Charles C.

[11] Patent Number: 4,697,485

[45] Date of Patent: Oct. 6, 1987

[54] DIE PRESS HAVING 3-AXIS REGISTRATION SYSTEM OPERABLE DURING MATERIAL ADVANCEMENT

[75] Inventor: Raney, Charles C., Kansas City, Kans.

[73] Assignee: Preco Industries, Inc., Lenexa, Kans.

[21] Appl. No.: 852,829

[22] Filed: Apr. 16, 1986

[51] Int. Cl.[4] ..... B26D 5/34; B26D 7/00

[52] U.S. Cl. ..... 83/34; 83/50; 83/71; 83/209; 83/216; 83/365

[58] Field of Search ..... 83/216, 209, 365, 71, 83/34, 50

[56] References Cited

U.S. PATENT DOCUMENTS

| | | | |
|---|---|---|---|
| 3,370,492 | 2/1968 | Treff | 83/71 |
| 3,385,244 | 5/1968 | Ramsey et al. | 112/2 |
| 3,919,561 | 11/1975 | Coberley | 250/561 |
| 4,151,451 | 4/1979 | Maertins, et al. | 318/568 |
| 4,555,986 | 12/1985 | Raney et al. | 83/209 |

FOREIGN PATENT DOCUMENTS 0109101 5/1984 European Pat. Off. .

*Primary Examiner*—Donald R. Schran

*Attorney, Agent, or Firm*—Schmidt, Johnson, Hovey & Williams

[57] ABSTRACT

A die cutting press for processing web material has a registration system which is operable to provide precise alignment of a shiftable die cutting unit along two axes during the time that the web material is advanced along a third axis toward the die unit, so that as soon as a defined area of the web reaches the die unit, the press can be immediately actuated to subject the web to the die cutting operation. In preferred forms of the invention, an indicator strip is printed on the length of the web and is detected by two spaced photo optical sensors movable with the die unit. A first control means, coupled to the sensors, selectively actuates in stepwise fashion either of two servomotors as may be necessary to bring the die unit into registration with defined web areas in a direction laterally of the web length (which may be defined as a Y axis) as well as a rotative orientation with respect to the defined web areas about an upright axis (which may be termed the $\theta$ axis). Once a defined web area approaches a position proximal to the die unit, advancement of the web is decelerated to a creep speed until an indicia mark is detected by a third sensor, whereupon advancement of the web is interrupted and a press ram is actuated to reciprocate to die unit and cut the defined area from the web. Continuous monitoring of the elongated indicator strip enables the die unit to be shifted as necessary to insure Y axis and $\theta$ axis registration prior to the time that web advancement is interrupted, so that the die unit can process the defined web area as soon as the latter reaches a position aligned with the die unit along an X axis that is parallel to the path of travel of the web.

15 Claims, 16 Drawing Figures

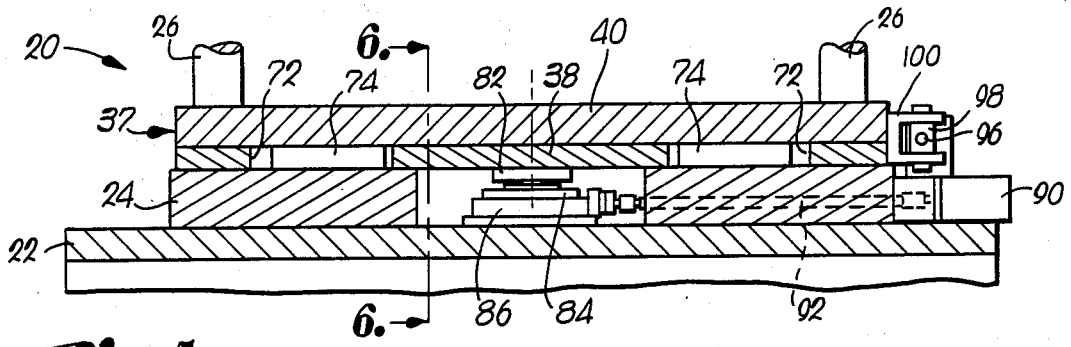
Fig.5.
Fig.6.
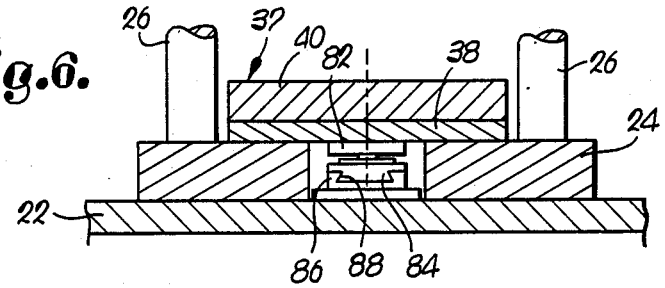
Fig.9.
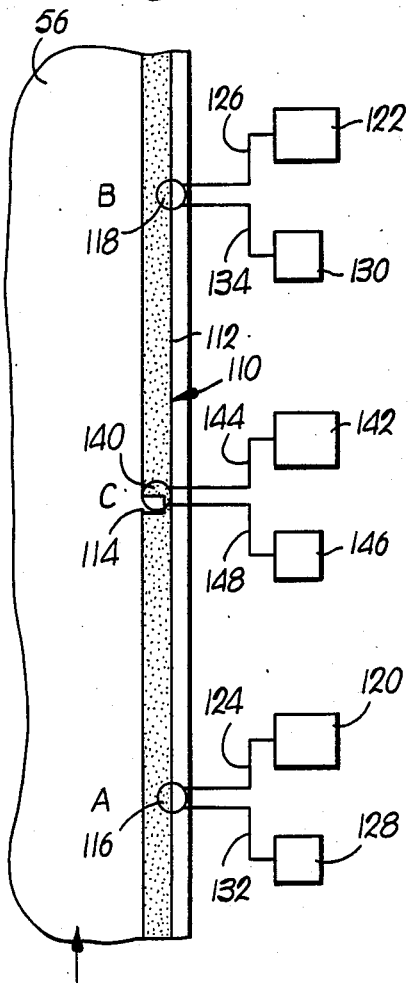
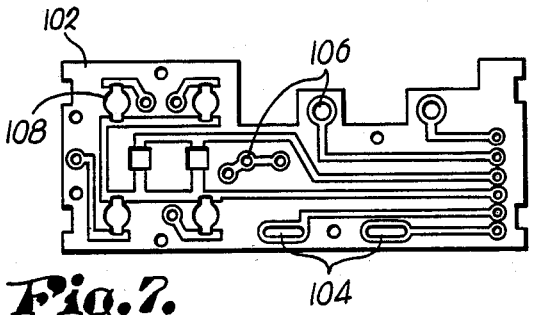
Fig.7.
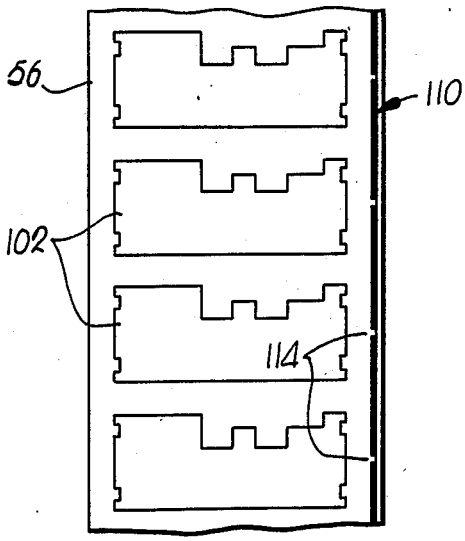
Fig.8.

(A)+(B)=0

(-A)+(+B)=-θ

(+A)+(-B)=+θ

(+A)+(+B)=-Y (-A)+(-B)=+Y

DIE PRESS HAVING 3-AXIS REGISTRATION SYSTEM OPERABLE DURING MATERIAL ADVANCEMENT

BACKGROUND OF THE INVENTION

1. Field of the Invention

This invention relates to a registration system for a web fed die cutting press wherein a continuous, printed indicator line or strip disposed longitudinally on a web is monitored by two sensors for controlling movement of a floating die unit in a direction laterally of the web along what may be called a Y axis and for rotation of the die unit about an upright axis defined as $\theta$, during the time that the web is advanced in a longitudinal direction along an X axis toward a press work station. Once the presence of an indicia mark corresponding to each area of the web to be processed is detected by a third sensor, advancement of the web is interrupted and a reciprocable ram of the press is shifted to effect immediate die cutting of the associated web area.

2. Description of the Prior Art

Conventional die cut presses known to those in the art are typically sheet fed units with sensors for detecting alignment indicia on each sheet, and wherein the work sheet is shifted as required to bring a defined image area of the sheet into proper registration with work structure of a die unit. While sheet fed presses can generally accurately cut defined individual areas or sections of each sheet, the speed at which such presses process a given number of die cut sheet areas is somewhat limited.

A die cutting press for web material that affords essentially automatic operation while providing a significantly greater speed of press operation in comparison to sheet fed units is disclosed in U.S. Pat. No. 4,555,968, dated Dec. 3, 1985 and assigned to the assignee of the present invention. The press disclosed in U.S. Pat. No. 4,555,968 has a shiftable die unit supported on a cushion of air, and the die unit is movable laterally of the direction of travel of the web as well as rotatably about an upright axis perpendicular to the web in order to bring the die unit into precise registration with defined areas of the web to be processed or cut by the press. Automatic operation of this press is provided by a control system having sensors which detect the presence of the indicia on the web, and the control system is electrically coupled to servomotor mechanisms for adjustably positioning the die unit once advancement of the web is interrupted and a defined area on the web is in general proximity to work structure of the press die unit.

In more detail, the control system of the die cutting press shown in U.S. Pat. No. 4,555,968 has two groups of photo-optical sensors which are disposed to sense the presence of two T-shaped marks that are located on opposite sides of the web adjacent each defined area of the web to be cut. One pair of sensors in each group is oriented to sense opposite sides of laterally extending legs of the respective T-shaped indicia, and each sensor detects reflectance levels that may be defined as $-X1$, $+X1$, $-X2$ and $+X2$. One of the sensor groups has a second pair of sensors positioned to detect a longitudinally extending leg of the associated T-shaped indicia to provide reflectance level signals that may be termed $+Y$ and $-Y$. The "X" reflectance levels are analyzed by a microprocessor for positioning the web longitudinally relative to the die unit and to rotatably orient the die unit about an upright axis, or $\theta$, while the "Y" reflectance levels are received by the microprocessor for positioning the die unit laterally of the web.

During operation of the press shown in U.S. Pat. No. 4,555,968, the web is advanced at a relatively high speed to bring each successive defined image area of the web into proximal relationship with the die unit work structure, and subsequently motors powering web feeding rollers are decelerated and incrementally actuated in a stepping fashion to advance the web in a "creep" mode through successive discrete increments of 0.0005 inch. The "X" reflectance level sensors are monitored by the microprocessor, the die unit is rotated as needed and the web continues to be advanced in the creep mode until the defined web area to be processed is correctly positioned about the $\theta$ axis as well as along the X axis (i.e. in a direction parallel with the length of the web). Subsequently, advancement of the web is interrupted, the "Y" reflectance levels sensors are monitored by the microprocessor and the die unit is shifted as needed along the Y axis (i.e. laterally of the web length) until the defined web area is in proper registration with the die unit. Next, the microprocessor deactivates air delivery to air bearings floatably supporting the die unit so that the latter comes to rest in a fixed position on a base platen in order that the ram of the press can be shifted to effect die cutting of the defined web area.

Although the web fed die cutting press having an automatic 3-axis die registration system as illustrated in U.S. Pat. No. 4,555,968 represents a significant advance in the art, it would of course be desirable to increase the operational speed of such a press so that greater amounts of web material can be processed. However, it is important that extreme registration accuracy of the die unit with the defined web areas be maintained so that the defined areas are precisely severed from the web within very small dimensional tolerances.

SUMMARY OF THE INVENTION

In accordance with the invention, a die cutting press is provided with a registration system that is operable to continuously maintain a floatable die unit in proper Y and $\theta$ registration with defined web areas to be processed as the web is advanced at a relatively high speed along an X axis toward the die unit. Movement of the web is placed in a creep mode once each image area is proximal to the die unit, and interruption of the web advancement and reciprocation of a ram platen occurs as soon as each defined web area is brought in creep mode to a proper X axis relationship relative to the die unit. The overall operational speed of the press is thereby significantly increased by continuous maintenance of Y and $\theta$ registration in contrast to known prior art registration systems wherein Y registration is achieved only after web advancement is arrested.

In more detail, the registration system as disclosed herein comprises a first sensing means movable with the die unit and having two spaced sensors positioned to determine the presence of an edge segment of an elongated indicator line or strip which is preferably printed continuously along the length of one side of the web material. The sensors, which each comprise a light source and photo transducer coupled by fiber optic cables to the shiftable die unit, continuously monitor light reflectance levels produced by the web and the indicator edge segment and a microprocessor operably connected to the sensors controls the operation of two separate servomotor mechanisms, one of which rotates the die unit about the referenced upright axis for $\theta$ positioning, and the other of which shifts the die unit laterally of the web for maintaining Y registration. The floatable die unit is intermittently moved as needed during web advancement at a relatively high speed.

As soon as a defined web area approaches the die unit, web advancement is decelerated to a creep speed which continues until a sensor of a second sensing means detects an indicia mark which is located in predetermined relationship to a corresponding web area. After the indicia mark is properly aligned with the die unit in a direction along an X axis, or parallel to the length of the web, a second control means interrupts advancement of the web. Thus, the press can be operated to cut the defined web area from the web as soon as X axis registration is attained.

Accordingly, the registration system of the press disclosed herein is operable to enable a significantly greater amount of web material to be processed during a given period of time in comparison to the known art, since Y axis and $\theta$ axis registrations are continuously maintained during advancement of the web between each die cutting operation, and the web is decelerated to a creep speed only to bring each web area into X axis registration. The system of this invention thus achieves registration at a speed greater than, for instance, the system disclosed in U.S. Pat. No. 4,555,968 wherein web advancement is retained in a creep speed to achieve X axis and $\theta$ axis alignment, and wherein subsequently advancement of the web is ceased while the die unit shifts to achieve Y axis registration.

In preferred forms of the invention, the indicia marks comprise notch-shaped nonprinted portions of a continuous indicator strip that is printed along one edge portion of the entire length of the web, and wherein an edge of the indicator strip of a side opposite from the nonprinted portions represents the segment that is continuously monitoredd by the two sensors of the first sensing means. Each of the nonprinted portions corresponds in positional relationship to an associated defined area of the web for X axis registration of the web area to the die unit.

BRIEF DESCRIPTION OF THE DRAWINGS

FIG. 5 is a fragmentary, vertical cross-sectional view taken substantially along line 5—5 of FIG. 4 to illustrate a pair of air bearings for floatably supporting the shiftable bolster as well as a dovetail connection pivotally connecting the bolster to a Y axis servomotor;

FIG. 6 is a fragmentary, vertical cross-sectional view taken along line 6—6 of FIG. 5 to further illustrate the dovetail connection;

FIG. 7 is a plan view of a typical part to be die cut from a web processed with the present die cut press, illustrating the complex configuration often encountered in die cutting operations wherein exterior and interior lines as well as holes, slots and other apertures must be cut or otherwise formed in the part or workpiece;

FIG. 8 is a fragmentary, reduced plan view of a web having images thereon corresponding to the workpiece illustrated in detail in FIG. 7, and showing a printed indicator strip positioned to one side of the web continuously along the length of the latter;

FIG. 9 is a simplified schematic illustration of the first and second sensing means of the present invention, including a light source and a photo transducer connected to flexible fiber optic cable that is secured to the die unit for movement therewith;

DETAILED DESCRIPTION OF THE DRAWINGS

Figure 2:
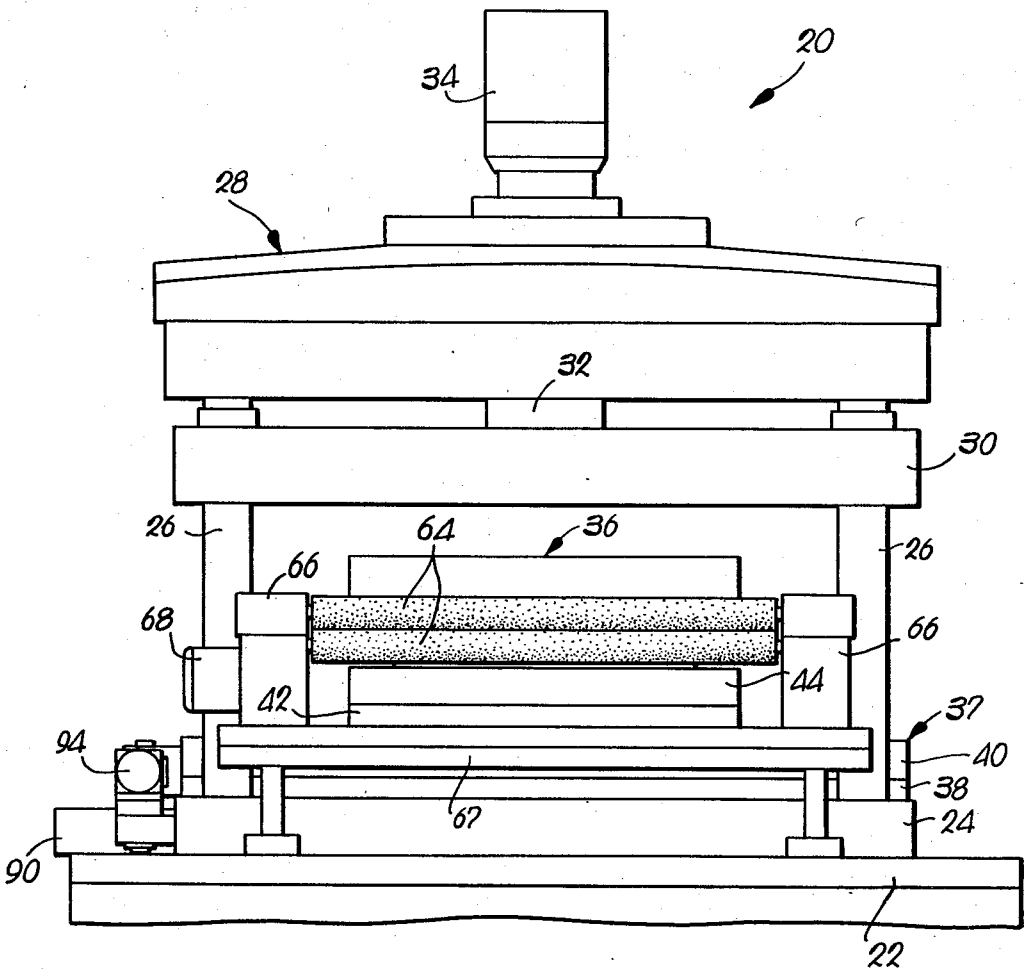
FIG. 2 is an end elevational view from the infeed end of the press as illustrated in FIG. 1.

A web fed die cutting press of the present invention is designated broadly by the numeral 20 and is best shown in FIGS. 1–6. With the exception of the registration system of the present invention to be described hereinbelow, the press 20 is in general similar to the press disclosed in the aforementioned U.S. Pat. No. 4,555,968 which is hereby expressly incorporated into the disclosure of the present invention.

The press 20 includes a horizontal support member 22 (see FIGS. 1–2) which carries a base platen 24 of relatively heavy, thick metal stock. Four upstanding rods 26 are fixed to respective corners of the base platen 24 and support an upper frame assembly 28. A ram platen 30 is reciprocably carried by the rods 26 below the frame assembly 28 and is vertically shiftable by means of a piston 32 secured to the frame assembly 28. A micrometer unit 36 mounted to the top of assembly 28 permits selective adjustment of the extent of vertical shifting of the ram platen 30.

Referring to FIGS. 1–4, a die unit or die set 36 rests on a floatable bolster 37 having a lower plate 38 that is engageable with the upper surface of the base platen 22. An upper plate 40 of the bolster 37 is mounted directly above the lower plate 38 and carries a spacer member 42 which, in turn, supports an overlying die holder 44 of die unit 36. Four springs 46 (FIG. 1) positioned adjacent corresponding corners of the die holder 44 yieldably support a die unit punch holder 48. A punch assembly 50 is fixedly secured to an underside of the punch holder 48, while a die assembly 52 is mounted to the top of the die holder 44.

The springs 46 are biased to normally hold the punch assembly 50 in spaced relationship to the die assembly 52 and present web material work structure therebetween. The ram platen 30 functions solely to selectively transmit a downwardly directed force to the punch assembly 50 so that the associated punches, in cooperation with the dies of the die assembly 52, sever or otherwide process defined areas of a web. As is conventional, the ram platen 30 is not affixed to any component of the die unit 36.

Figure 1:
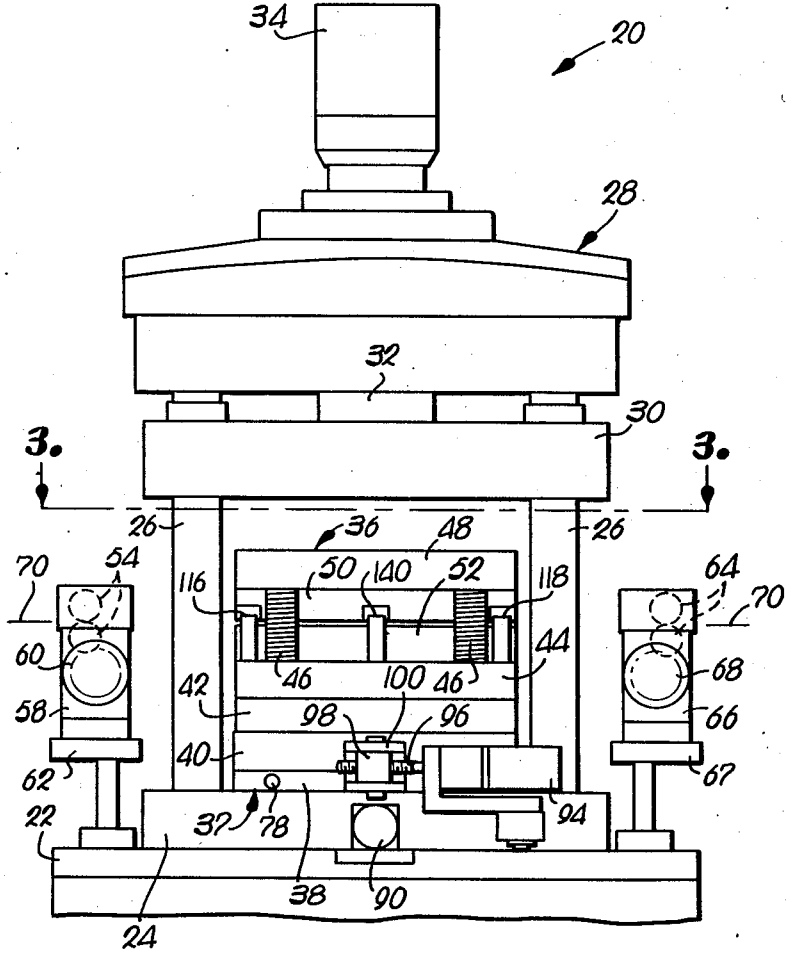
FIG. 1 is a side elevational view of a die cutting press constructed in accordance with the principles of the present invention and illustrating a base platen, a die unit carried by the base platen, a reciprocable, power operated ram platen, and servomotors for advancing a web, rotating the die unit around an upright axis and shifting the die unit laterally of the web.
Figure 3:
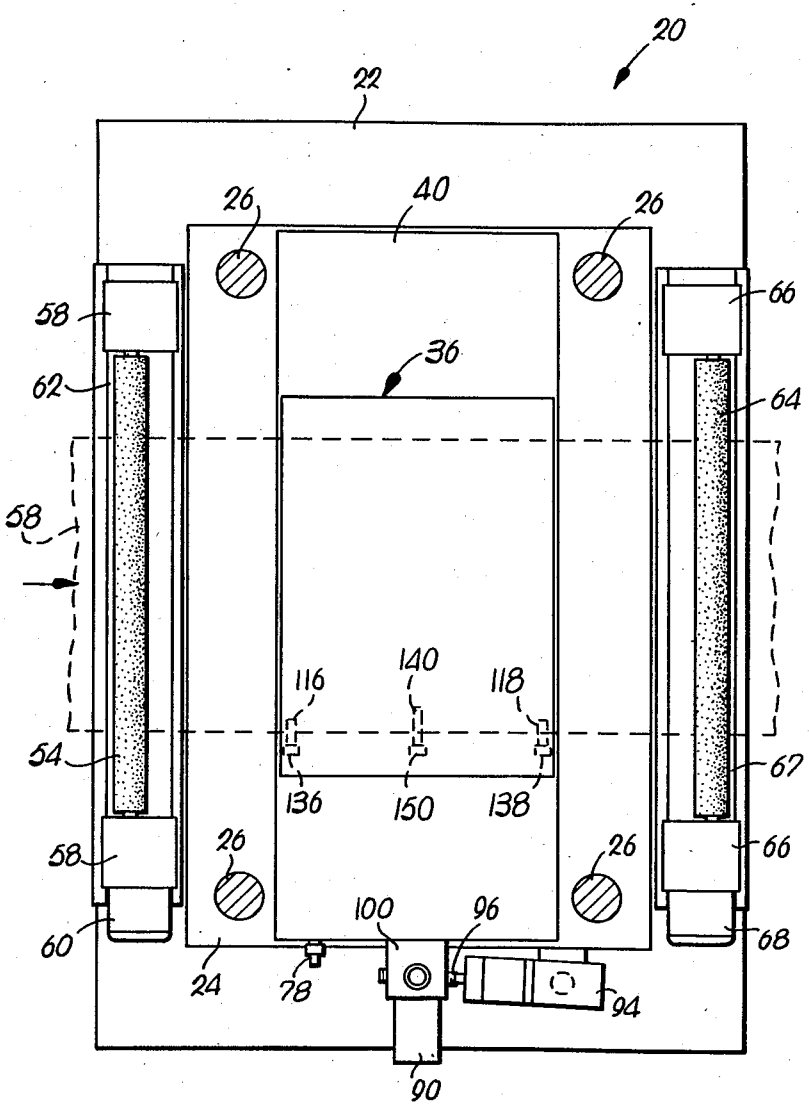
FIG. 3 is a horizontal cross-sectional view taken substantially along line 3—3 of FIG. 1, particularly illustrating the sensors of the first and second sensing means and two web advancement rollers, as well as showing the web in phantom lines.

As illustrated in FIGS. 1–3, the press 20 has a horizontally spaced, vertically aligned pair of infeed rollers 54 that are frictionally engageable with web material such as an elongated web 56 for advancing the latter in a direction parallel to the length of the web 56 toward the work structure of die unit 36. The rollers 54 are rotatably supported on each end by bearers 58, and the lower infeed roller 54 is driven by a DC powered, X axis servomotor 60 carried by one of the bearers 58. A horizontally extending support table 62 (FIGS. 1 and 2) is secured to the member 22 and carries the bearers 58.

Viewing FIGS. 1 and 3, the web outfeed end of the press 20 has a pair of horizontally spaced, vertically aligned outfeed rollers 64 that are generally identical with the infeed rollers 54 and function to support the web 56 therebetween. The rollers 64 are rotatable fixed at each end thereof to bearers 66 supported by a table 67, and a DC X axis servomotor 68 which powers the lower outfeed roller 64 is wired in parallel with the X axis servomotor 60, so that the lower infeed roller 54 rotates in synchronous movement to rotation of the lower outfeed roller 64. The path of the web 56 through the press 20 is designated schematically by lines 70, 70 in FIG. 1, and the web 56 is shown in phantom by the dashed lines in FIG. 3.

Although not shown, it is to be understood that an additional pair of infeed rollers for supporting and advancing the web 56 may optionally be disposed between the illustrated rollers 54, 54 and the die unit 36. Similarly, an additional pair of outfeed rollers may be located between the die unit 36 and the illustrated outfeed rollers 64, 64. Preferably, the lower rollers of the optional, additional roller pairs are driven by means such as a timing belt from the depicted rollers 54, 64 to insure synchronous rotative movement of all of the web engageable rollers as the web 56 continues to advance through the press 20.

Figure 4:
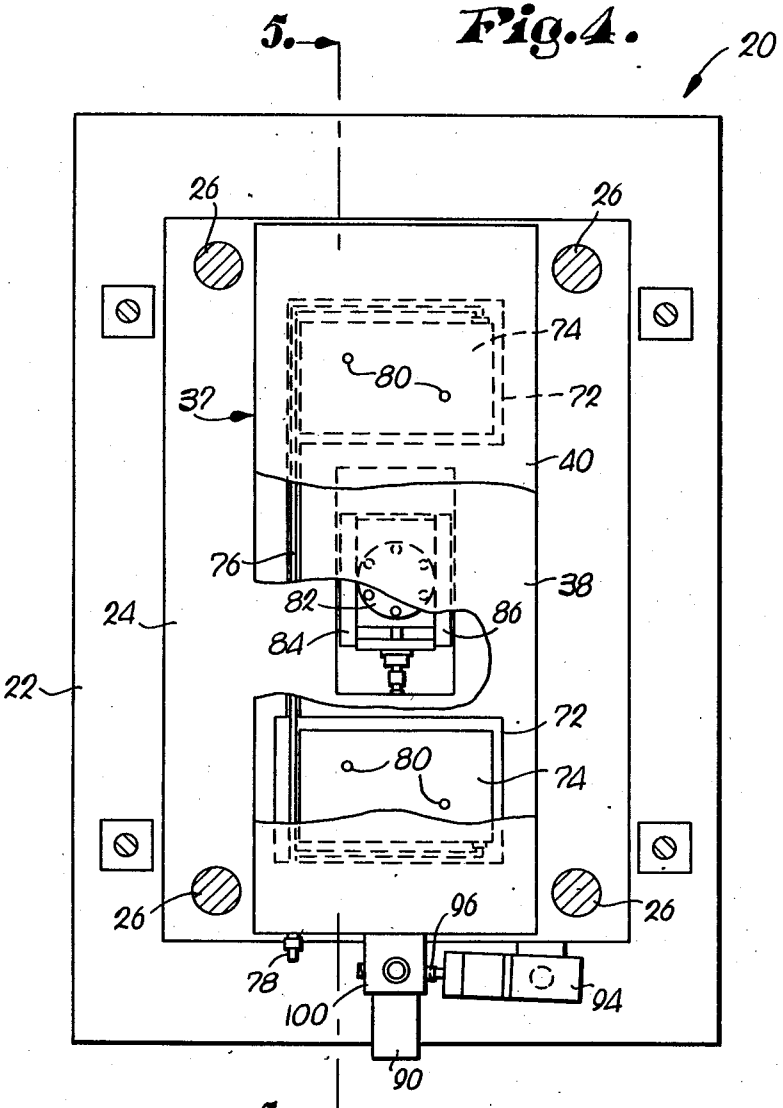
FIG. 4 is a horizontal cross-sectional view taken along generally the same line as line 3—3 of FIG. 1 with parts broken away for clarity and in section to reveal to die unit shifting means and a pair of plates comprising a floating bolster of the press.

Directing attention next to FIGS. 4 and 5, the lower plate 38 of the bolster 37 has two rectangular openings 72 which clearingly receive corresponding air bearings 74 that have a plurality of air outlet ports disposed downwardly in facing relationship to the upper surface of the base platen 24. The bearings 74 are connected by a conduit 76 and fitting 78 to a source of pressurized air so that the bolster 37 and thus the die unit 36 can be selectively supported by a cushion of air for purposes to be explained hereinafter. Pins 80 secured to the upper plate 40 maintain the bearings 74 in proper positional disposition within corresponding rectangular openings 72.

Referring to FIGS. 5 and 6, the lower plate 38 of bolster 37 is secured to a support 82 which in turn is pivotally connected to a slide member 84. A stationary element 86, secured to the support member 22, has a horizontally extending groove 88 that presents a dovetail configuration in transverse cross-section. The member 84 has a lower portion which is slidably received in the groove 88 and is complemental in configuration to the same. A bearing (not shown in detail) which rotatably couples the support 82 to the slide member 84 allows the support 82 and thereby the components resting thereon (bolster 37 and die unit 36) to shift vertically through a limited displacement without permitting such components to shift laterally.

A DC powered, Y axis servomotor 90, best illustrated in FIG. 5, is connected to a shaft 92 that includes a threaded member which is received by a threaded portion of the slide member 84. Operation of the motor 90 effects rotation of the shaft 92 to slide the member 84 along groove 88, so that the bolster 37 and thereby the die unit 36 can be selectively shiftable in a direction which may be termed a Y axis. As will be understood, the Y axis is horizontally transverse to the path of travel of the web 56 as the latter advances through press 20.

As shown best in FIGS. 1, 3 and 4, a DC powered, $\theta$ axis servomotor 94 is pivotally coupled to the base platen 24 and has a threaded shaft 96 that is complementally received in a pentle 98. Viewing FIG. 1, the pentle 98 is pivotally connected to a bracket 100 which, in turn, is secured to bolster 37. The servomotor 94 is selectively actuatable to rotate the shaft 96 and thereby shift the pentle 98 such that the bolster 37 is moved in a arc about a vertical axis designated $\theta$.

For exemplary purposes only, the web 56 has been illustrated in FIG. 8 as having a series of defined areas 102 thereon which represent the outline of the area to be subjected to a processing operation at the work structure of die unit 36. It is to be understood in this respect that the design of the web areas 102 as shown is for illustrative purposes only and that many other various shapes may be suitably processed by press 20 using a die shape that is constructed to produce the desired configuration. In FIG. 7, one of the exemplary defined areas 102 as represented in FIG. 8 is shown in more detail and has irregular internal as well as external configured portions, including holes, slots and other areas that are to be stamped, cut, punched or embossed. The defined web area 102 in FIG. 7 represents a circuit board, wherein slots which are to be die cut by the unit 36 are indicated by the numeral 104, while holes which are to be punched by unit 36 are indicated by 106, and apertures 108 require die punchiing by unit 36. As can be appreciated, alignment of the die unit 36 to the defined web area 102 is to be maintained on an extremely precise basis and is preferably within a tolerance of $\pm 0.0005$ inch.

A registration system of the press 20 includes an indicator means or an elongated indicator strip 110 which advantageously is printed directly on the web 56 on one side thereof and substantially along the length of the same, as shown in FIGS. 8–14. The indicator strip 110 has an elongated edge segment 112 which has a predetermined location relative to the defined areas 102 of the web 56 in directions transverse to the longitudinal axis of web 56.

The registration system of press 20 also includes a plurality of indicia means or marks 114 which preferably take the form of notched, nonprinted portions of the strip 110 remote from the edge segment 112, as may be best understood by reference to FIG. 9. Each of the indicia marks 114 has a predetermined orientation relative to an adjacent defined area 102 of the web 56 in a direction parallel with the longitudinal axis of the latter. The indicator strip 110 advantageously has light reflectance properties substantially different than adjacent areas of the web 56, and thus each of the nonprinted, indicia marks 114 has light reflectance properties different than adjacent portions of the strip 110.

The registration system of press 20 also includes a first sensing means comprising two spaced sensors 116, 118 that are movable with the die unit 36. Viewing FIG. 9, each of the sensors 116, 118 comprises a light source 120, 122 respectively and a fiber optic bundle 124, 126 correspondingly each having a series of flexible light transmitting glass fibers. The sensors 116, 118, are associated with a photo optical device such as photo transistors 128, 130 respectively that are operably coupled to flexible fiber optic cable bundles 132, 134 respectively. The light emitting ends of individual fibers in the bundle 124 are positioned in intermixed and adjacent relationship to light receiving fiber ends of bundle 132, so that the photo transistor 128 essentially detects an average value of light reflectance as a result of light emanating from the source 122. Similarly, the individual fibers of the light emitting end of the fiber optic bundle 126 are positioned in adjacent, intermixed relationship with the light receiving ends of the individual fibers comprising bundle 134 so that the photo transistor 130 essentially detects an average value of light reflectance as a result of radiation originating from source 122. As is well known to those in the field, the resistance of photo transistors varies in accordance with the amount of received light, and thereby the photo transistors in effect operate to provide a "signal" for reasons which will become apparent hereinafter.

Referring to FIG. 3, a bracket 136 is connected to the outboard end of fiber optic bundles 124, 132 to secure the intermixed fiber ends in a position for sensing the edge segment 112 of indicator strip 110. Similarly, a bracket 138 is affixed to the outboard end of bundles 126, 134 to position the intermixed fiber ends properly to sense the presence of indicator strip edge segment 112. Both of the brackets 136, 138 are secured to the die unit 36 for movement therewith.

The registration system of the press 20 also includes a second sensing means that comprises a sensor 140 (FIGS. 3 and 9) positioned to sense the presence of a portion of the indicia means or marks 114 as the web 56 is advanced toward the die unit 36. The sensor 140 includes a light source 142 operably connected to a flexible fiber optic bundle 144 having a plurality of individual light transmitting fibers, and the sensor 140 also includes a photo optical device or photo transistor 146 that is operably connected to a fiber optic bundle 148 comprising a number of individual, flexible light transmitting fibers. The ends of the bundles 144, 148 remote from the light source 142 and photo transistor 146 respectively are secured to a bracket 150 and are arranged such that the ends of the individual fibers of bundle 144 are interspersed with the ends of individual fibers of bundle 148. As a result, photo transistor 146 receives in effect an average value of light reflectance as a result of energy radiating from light source 142.

OPERATION

In use, infeed rollers 54 and outfeed rollers 64, powered by servomotors 60, 68 respectively advance the web 56 toward the work structure of die unit 36 in a direction parallel to the longitudinal axis of the web 56 and initially at a relatively high speed. Advancement of the web continues at high speed until a defined area 102 of web 56 reaches a position proximal to the work structure of die unit 36, whereupon a microprocessor (not shown) causes the motors 60, 68 to decelerate the web 56 and thereafter incrementally advance the web in stepping fashion through discrete, successive increments of 0.0005". In practice, the distance that the web 56 is to be advanced at the relatively high speed is preprogrammed into the microprocessor, although alternatively a timing mark or indicia may be imprinted on the web 56 for sensing by a sensor in order to decelerate the speed of web 56 from a relatively high speed to a relatively low, or creep speed.

During the time that the web 56 is advanced at the relatively high speed, the sensors 116, 118 of the first sensing means are continuously monitored by a second microprocessor to effect shifting of the die unit 36 as may be necessary to bring the work structure of die unit 36 into Y axis and $\theta$ registration with defined areas 102 of web 56. Referring now to the schematic representations shown in FIGS. 9–14, and the flow chart of the microprocessor in FIG. 15, the a first signal from photo transistors 128, 130 is directed to a first control means of the registration system to determine light reflectance values received by photo transistors 128, 130 respectively that emanate from light sources 120, 122 respectively and reflect from web 56. The indicator strip 110, including edge segment 114, has a light reflectance value different than adjacent areas of the web 56, and the first control means monitors photo transistors 128, 130 and compares the received reflectance levels to a predetermined "high threshhold" reflectance level and a "low threshhold" reflectance level.

Figure 10:
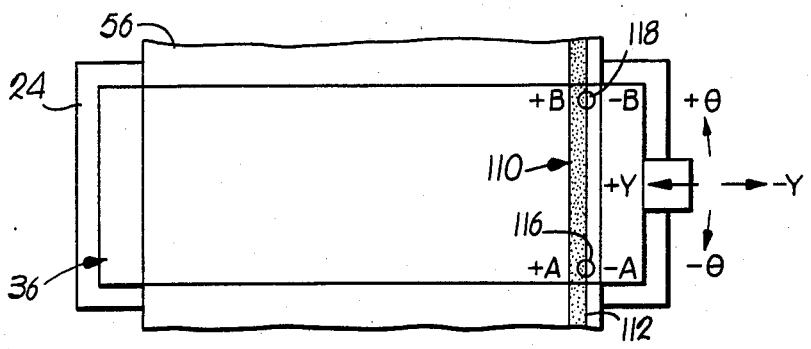
FIGS. 10–14 inclusive are schematic illustrations depicting edge segment sensing of the indicator strip printed on a web material for continuous Y axis and $\theta$ axis alignment of the web images to the floating die unit as the web is advanced to bring each successive, defined area of the web to the die unit to be processed or cut.

Viewing FIG. 10, the web 56 is shown in registration with the work structure of die unit 36 along the Y axis as well as the $\theta$ axis. The sensor 116 detects a reflectance level termed A, which in the example of FIG. 10 is smaller than the high threshhold reflectance level but is greater than the low threshhold reflectance level. The sensor 118 senses a reflectance level termed B, and in FIG. 10 the level B is smaller than the high threshhold reflectance level but greater than the low threshhold reflectance level. As such, the Y axis servomotor 90 and the $\theta$ axis servomotor 94 remain in an idle state and the die unit 36 is not moved. That is, the die unit 36 is now in a predetermined positional relationship each defined web area 102 in a direction laterally of the length of web 56 (i.e., along the Y axis) as well as in rotative orientation about the upright axis $\theta$. Viewing FIG. 15, when die unit 36 is in Y axis and $\theta$ axis registration as depicted by FIG. 10, the second microprocessor schematically follows the dashed line flow path and it can be seen that neither of the servomotors 90, 94 are actuated.

Figure 11:
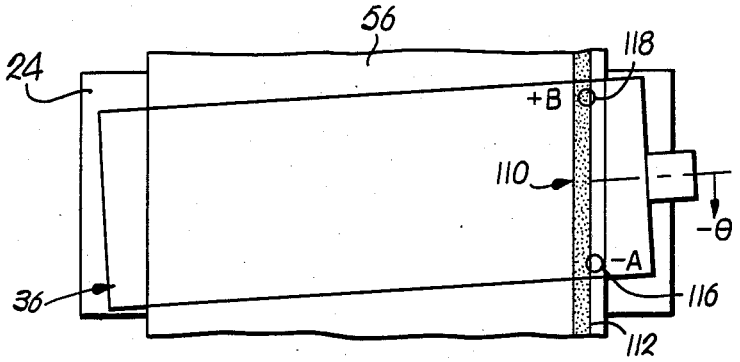

In FIG. 11, the work structure of die unit 36 is shown for illustrative purposes as being out of alignment with defined web areas 102 in a rotative direction about the $\theta$ axis. In such a case, the reflectance level A detected by sensor 116 is smaller than the high (or low) threshhold reflectance level and the level B detected by sensor 118 is greater than the high threshhold reflectance level. The control means will then actuate the $\theta$ servomotor 94 in incremental, stepwise fashion in a clockwise direction to shift the work structure of die unit 36 toward a position of $\theta$ axis registration with defined web areas 102.

Figure 12:
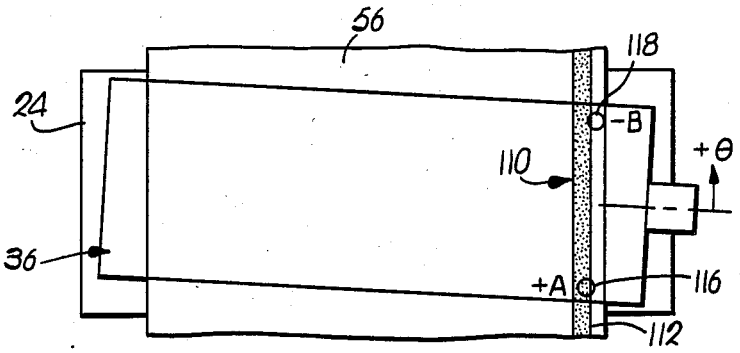

FIG. 12 represents for exemplary purposes an instance wherein the work structure of die unit 36 is out of $\theta$ axis registration with defined web areas 102 in a direction opposite from the case shown in FIG. 11. In FIG. 12, the sensor 116 detects a reflectance level A greater than the high threshhold reflectance level and the sensor 118 detects a reflectance value B smaller than the high (or low) threshhold reflectance level. As a result, the first control means actuates the $\theta$ axis servomotor 94 to rotate the die unit 36 one step in a counterclockwise direction.

Figure 13:
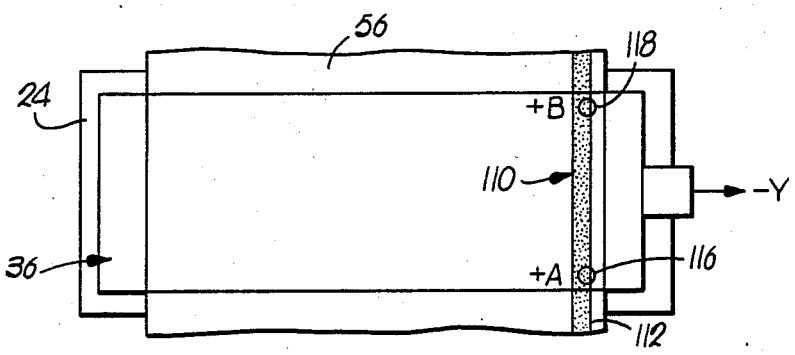
Figure 14:
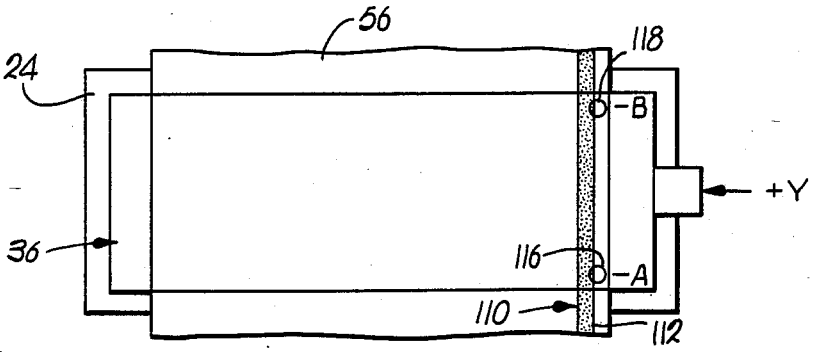

If both of the sensors 116, 118 detect reflectance levels that are greater than the high threshhold reflectance level, as shown in FIG. 13, the first control means actuates the Y axis servomotor 90 for movement of die unit 36 one step in an "out" direction. On the other hand, if for instance both of the sensors 116, 118 deflect reflectance levels that are smaller than the low threshhold reflectance level, than the first control means actuates the Y axis servomotor 90 for movement in die unit 36 one stem in an "in" direction.

Figure 15:
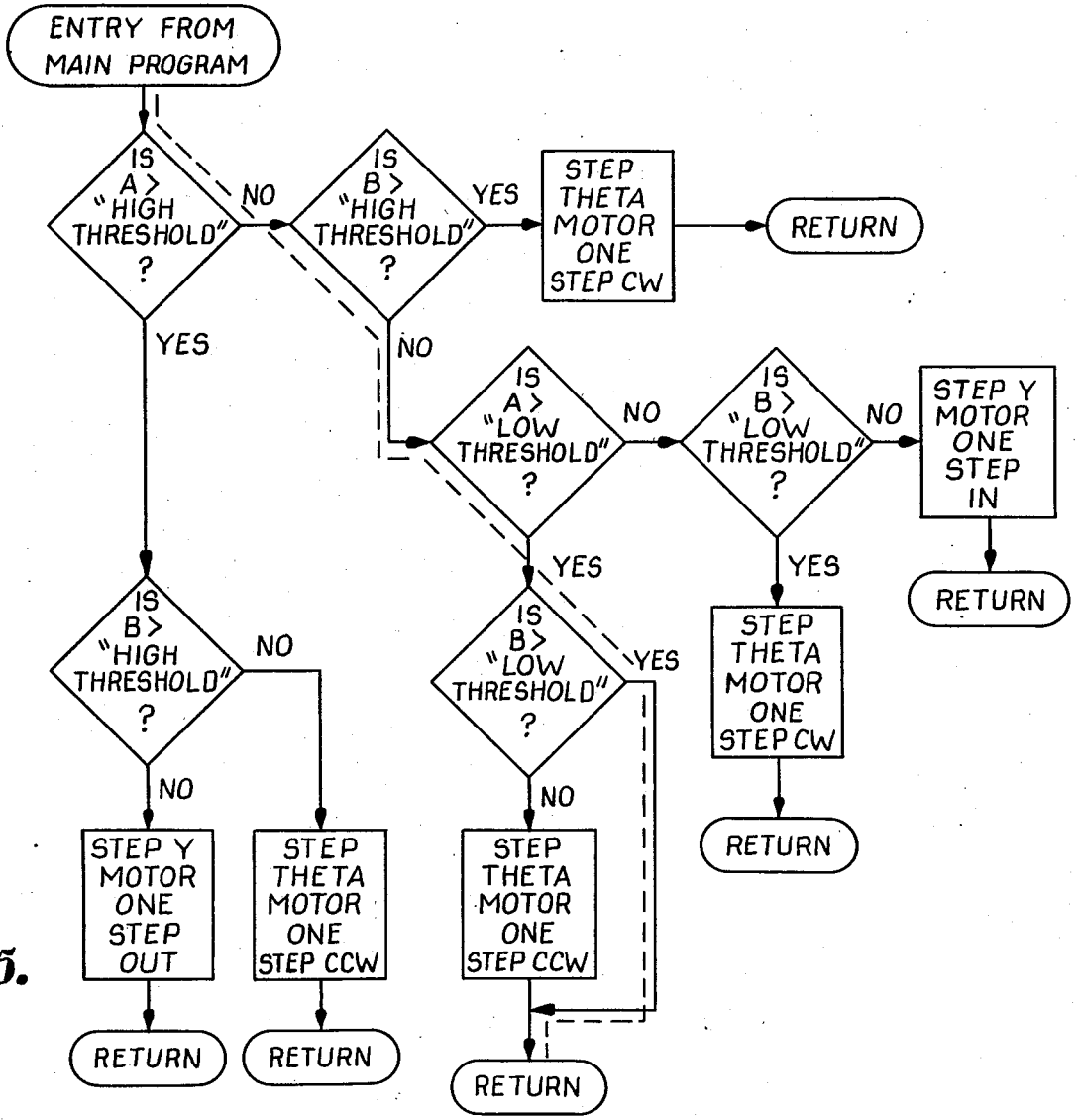
FIG. 15 is a flow chart illustrating in simplified form the manner in which a microprocessor of the present invention functions to control operation of Y and $\theta$ servomotors during advancement of the web.

In normal use of press 20, as the web 56 is advanced at the aforementioned relatively high speed by the X axis servomotors 60, 68, the second microprocessor continuously implements the logic steps schematically depicted in FIG. 15 so that the work structure of die unit 36 is maintained in Y axis and $\theta$ axis registration to define web areas 102. The first control means, including the second microprocessor, adjusts the position of die unit 36 by power operated shifting means which comprise the Y axis servomotor 90, the $\theta$ axis servomotor 94, the support 82, the slide member 84, the stationary element 86, as well as shafts 92, 96 and pentle 98. During advancement of the web 56 at the relatively high speed, compressed air is directed through the conduit 76 to air bearings 74, 74 so that the bolster 37 floats on a cushion of air and can be readily shifted by Y axis servomotor 90 and $\theta$ axis servomotor 94.

Figure 16:
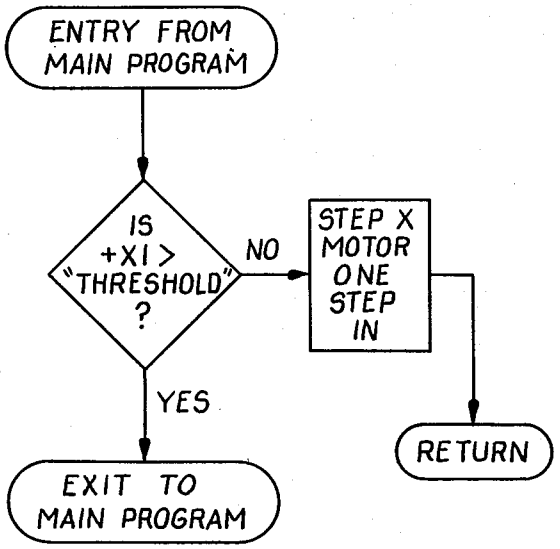
FIG. 16 is a simplified flow chart showing the operation of another microprocessor which functions to advance the web in a creep speed unitl X axis registration is achieved.

When the X axis servomotors 60, 68 are decelerated by the first microprocessor to subsequently advance the web 56 at the relatively low, creep speed, a second control means of the registration system implements the schematically depicted flow chart program in FIG. 16. As shown, the second control means incrementally advances the motors 60, 68 in stepwise fashion to advance the web 56 until an indicia mark 114 corresponding to the next defined web area 102 to reach the die unit 36 approaches the sensor 140 of the second sensing means. The second control means has a preprogrammed, "threshhold" reflectance level, and determines whether the light received by sensor 140 is greater than the threshhold reflectance level. As soon as the reflectance level (which may be termed "X1") detected by sensor 140 is greater than the threshhold reflectance level, photo transistor 146 provides a signal to second control means and continued stepwise operation of the X axis servomotors 60, 68 is suspended whereupon the microprocessor exits the subprogram illustrated in FIG. 16 and returns to the main program.

Subsequently, air supply to bearings 74, 74 is arrested to fix the position of bolster 37, and piston 32 of press 20 is extended to shift the ram platen 30 downwardly and thereby press punch holder 48 toward die holder 44 against the bias presented by springs 46. Next, the piston 32 is returned to a retracted position, thereby lifting the ram platen 30 to open the die unit 36 as soon as springs 46 shift the punch holder 48 away from die holder 44. At this time, processing of the work piece of defined area 102 by the die unit 36 is complete and the microprocessor again actuates the X axis servomotors 60, 68 to accelerate web 56 to the relatively high advancement speed.

It should now be appreciated that the registration system as disclosed herein offers considerable advantages over prior art systems wherein alingment of a die unit occurs only after advancement of the web is interrupted. By maintaining X axis and $\theta$ axis registration of the die unit relative to the defined web areas 102 at all times during advancement of web 56 in accordance witht he principles of the present invention, the operational speed of press 20, in terms of defined web areas 102 processed per unit time, is significantly increased.

It is to be understood that various details of construction and/or operation may be modified from the specifically disclosed preferred embodiment and application chosen for illustration, without departing from the essence of the invention. In this regard, the edge segment 112 of indicator 110 may instead take the form of the adjacent cut edge or an edge segment of the web 56. Also, the indicia marks 114, which are illustrated as notched, nonprinted portions of indicator strip 110, may instead by a series of separate marks (printed or cut into the web 56) disposed to one side of the strip 110. The web 56, in the context of the present invention, can take the form of any length of material having more than one defined area thereon for successive die processing, and can therefore include rolls of material as well as sheet stock. Accordingly, it is to be understood that the invention should be deemed limited only by the fair scope of the claims which follow, when the latter are reasonably interpreted to encompass manifest mechanical and electrical equivalents.

What is claimed is:

1. A method of successively aligning a die unit work structure of a die cutting press with defined areas of elongated we,b material during movement of said defined areas toward the work structure of the press, said method comprising the steps of:

moving said web material by advancement means toward said work structure of the die cutting press in a direction parallel to the longitudinal axis of said web material;

sensing an elongated indicator segment disposed longitudinally of said web material while said web material is moving toward said work structure;

providing a first signal in response to sensing of said indicator segment to a first power operated shifting means and to a second power operated shifting means;

shifting said die unit in response to said first signal by said first shifting means in a straight direction laterally of said web advancement direction while said web material is moving toward said work structure as may be necessary to successively bring said die unit work structure into predetermined positional relationship relative to each of said web defined areas in a direction laterally of said web advancement direction;

rotating said die unit in response to said first signal by said second shifting means about an axis perpendicular to a plane containing said web material while said web material is moving toward said work structure as may be necessary to successively bring said die unit work structure into a predetermined rotative orientation relative to each of said web defined areas;

sensing an indicia means associated with each of said defined areas and disposed on said web material while said web material continues to move toward said work structure;

providing a second signal in response to sensing of said indicia means to said web advancement means when said indicia means is located in predetermined positional relationship relative to said work structure in a direction longitudinally of the web material; and interrupting the movement of said web material in response to said second signal by said web advancement means whereby a respective defined area is in registration with said work structure as soon as said web movement is interrupted to permit immediate die cutting by said press die unit without further shifting or rotation of the latter.

2. The method of claim 1, wherein said step of sensing said indicator segment includes the use of two sensors carried by the die unit in disposition spaced longitudinally of the direction of movement of the web toward said work structure.

3. The method of claim 2, wherein said two sensors are spaced apart a distance comprising a substantial part of the extent of the web material occupied by each of the areas thereof in the direction of web movement into said press work station.

4. The method of claim 1, wherein said step of moving the web material includes moving the web material at a relatively high velocity, and decelerating the web material to a creep speed immediately prior to said step of interrupting the movement of said web material.

5. In a die cutting press for elongated web material having indicator means including an elongated segment extending in parallel relationship with the longitudinal axis of said web material in a predetermined orientation relative to defined, successive areas of the web in directions transverse to the longitudinal axis of said segment, said web material also having a plurality of indicia means each positioned in a predetermined orientation relative to a corresponding one of said defined areas of said web material in a direction generally parallel with the longitudinal axis of said web material, said press including a base platen, a ram platen shiftable toward and away from said base platen, a die unit received in the space between said base platen and said ram platen and having work structure for processing the web material, means for longitudinally advancing the web material along a path of travel to successively feed said defined areas of the web material toward said die unit work structure, and means mounting said die unit on said base platen, a registration system for successively positioning said die unit during movement of the web to bring said work structure into predetermined relationship to said defined areas of said web material as successive areas are brought into a position to be processed by the work structure and including:

sensing means associated with the press and having at least two sensors located along the longitudinal length of the web material positioned to sense said elongated segment of said indicator means while said web material is moving toward said press work station;

means coupled with said sensing means for providing a first signal in response to the relative alignment or lack of alignment of said elongated segment with respect to said at least two sensors;

first power operated shifting means connected to said die unit for rotating the latter relative to said base platen about a reference axis perpendicular to a plane containing said web material;

first control means connected to said first signal providing means and said first shifting means for actuating said first shifting means in response to said first signal while said web material is moving in order to bring said die unit work structure into predetermined rotative orientation relative to said elongated segment while said web material is moving toward said press work structure;

second power operated shifting means for movement of said die unit relative to said base platen along a straight direction of travel transverse to said path of travel of said web material, said first control means being connected to said second shifting means for actuating said second shifting means in response to said first signal while said web material is moving in order to bring said die unit work structure into predetermined positional relationship relative to said elongated segment in a direction transverse to said web longitudinal axis, said sensing means also being positioned to sense the presence of at least a portion of each indicia means when the latter has moved into a predetermined position relative to the sensing means while said web material is moving;

means coupled to said sensing means for providing a second signal when said at least a portion of each indicia means has moved into said positional relationship; and second control means connected to said second signal providing means and said web advancement means to interrupt advancement of the web material in response to said second signal, whereby said die unit work structure is in proper, aligned registration to each of said web defined areas in a rotative orientation about said reference axis as well as in a direction transverse to said web longitudinal axis to enable successive processing of each web defined area by said die unit work structure as soon as said second control means interrupts advancement of the web material.

6. The invention of claim 5, wherein said sensing means includes a sensor connected to said second control means and spaced from said at least two sensors in a direction laterally of a reference line extending through said plurality of sensors, for detecting said portion of each of said indicia means as said web material moves toward said die unit work structure.

7. The invention of claim 5, wherein said sensing means is coupled to said die unit for movement therewith.

8. The invention of claim 5, includiing means for supporting said die unit on a cushion of air as said die unit is rotated about said upright axis.

9. The invention of claim 5, including means for supporting said die unit on a cushion of air as said die unit is moved in a direction transverse to the path of travel of said web material toward the press.

10. The invention of claim 5, wherein said sensing means comprises photo optical devices.

11. The invention of claim 10, wherein said sensing means includes flexible light transmitting glass fibers.

12. The invention of claim 5, wherein said indicator means comprises a line having light reflectance properties different than adjacent areas of the web material.

13. The invention of claim 12, wherein said indicia means is formed as part of said indicator means.

14. The invention of claim 13, wherein said indicia means comprises a plurality of non-printed portions in said indicator means.

15. The invention of claim 5, wherein said at least two sensors of the sensing means are spaced apart a distance comprising a substantial part of the extent of the web material occupied by each of said defined areas thereof in the direction of web movement in said press work station.

* * * * *